United States Patent [19]

Schook

[11] Patent Number: 4,948,123

[45] Date of Patent: Aug. 14, 1990

[54] QUICK RELEASE DUMBELL AND BARBELL EXERCISE EQUIPMENT

[76] Inventor: Michael N. Schook, 121 Lycoming Dr., Coraopolis, Pa. 15108

[21] Appl. No.: 451,887

[22] Filed: Dec. 18, 1989

[51] Int. Cl.[5] ..... A63B 21/075

[52] U.S. Cl. ..... 272/123; 272/122

[58] Field of Search ..... 272/93, 116, 117, 122, 272/123, 124, 143; 403/34; 248/205.8, 206.2

[56] References Cited

U.S. PATENT DOCUMENTS

| | | | |
|---|---|---|---|
| 4,529,197 | 7/1985 | Gogarty | 272/122 |
| 4,566,690 | 6/1986 | Schook | 272/123 |
| 4,569,105 | 2/1986 | Weider | 272/123 X |
| 4,638,994 | 1/1987 | Gogarty | 272/122 |
| 4,817,944 | 4/1989 | Anderson et al. | 272/123 |

*Primary Examiner*—Robert W. Bahr

*Attorney, Agent, or Firm*—Webb, Burden, Ziesenheim & Webb

[57] ABSTRACT

A weight training apparatus which includes an elongated handle and one or more separate weights mounted to each other and to the handle. The handle has an end plate on each end and a male connector extending outwardly therefrom. Each weight has a female connector recessed therein and having a configuration complementary to the male connector. A suction cup is attached to the weight within the female connector. A weight is positioned on the handle with the female connector engaged with the male connector and with the suction cup connected to an engagement face on the male connector. A release device removes the suction cup from engagement with the male connector.

20 Claims, 2 Drawing Sheets

QUICK RELEASE DUMBELL AND BARBELL EXERCISE EQUIPMENT

BACKGROUND OF THE INVENTION

1. Field Of The Invention

This invention relates to dumbell and barbell weight training and exercise equipment and, more particularly, to dumbell and barbell equipment with weights which are easy to attach and remove.

2. Description Of The Prior Art

A wide variety of weight training and exercise equipment are known, including the fixed or variable weight type of exercise machines, cast dumbells, and the free weight/bar combination. Exercise machines are easy to use when moving from one exercise to another or when changing weights; however, these machines are relatively expensive and are not readily useable in the home. Many body builders or other exercise enthusiasts prefer to use free weights, either alone or to complement a work-out on an exercise machine.

Solid dumbells are easy to use and provide ease in switching from one weight to another. However, the weight of the individual dumbell is fixed and cannot be easily increased or decreased. Thus, a user is required to purchase and store pairs of dumbells covering a wide range of weights. Free weight plates, mounted on a longer barbell or shorter dumbell bar, overcome many of the problems associated with solid dumbells. With a single, elongated bar, a single pair of shorter dumbell bars, and a variety of weights, barbells or dumbells of any desired weight can be assembled and a change from one weight to another can be easily effected.

There are several problems with the use of free weight/bar combinations. The weights are typically held on the bar by a securing means, typically by a removeable collar. The collar, particularly when used on a dumbell bar, often cannot withstand the stress from the weight. In order to change weights, the collar is released and removed from the bar, the weight is removed from the bar, a new weight is positioned on the bar, and the collar is positioned on the bar against the weight and secured in place. This is a time-consuming process which often interferes with the smooth flow of a weight training session.

In my prior U.S. Pat. No. 4,566,690, I disclosed a dumbell and barbell weight training device which securely held the changeable weights in place, yet permitted the weights to be quickly and easily changed. However, it has developed that this arrangement is relatively expensive to manufacture.

Accordingly, it is an object of the present invention to provide a weight training apparatus which has easily removeable weights that are securely held in position when in use. It is a further object to provide these features in a weight training apparatus which is inexpensive to manufacture.

SUMMARY OF THE INVENTION

Accordingly, I have invented a weight training apparatus which includes an elongated handle having an end plate on each end thereof. A male connector extends outwardly from an outer face of each of the end plates and has an engagement face thereon. The invention also includes at least one weight adapted to be mounted to each of the end plates on the handle. Each weight includes a weight body having an inner face thereon and a female connector recessed into the inner face. The female connector has a configuration which is complementary to the male connectors on the end plates. A suction means, preferably a suction cup, is attached to the weight within the female connector. The female connector is adapted to engage the male connectors on the handle and the suction means is adapted to engage the engagement faces on the male connectors. In this manner, a weight is joined to the handle. The invention also includes a means for selectively releasing the suction means from engagement with the engagement faces of the male connectors.

The release means can include an access hole extending through the weight body to the female connector and a release wire connected to the suction cup and extending into the access hole. A foam ring may be provided on the outer face of each of the end plates and surrounding the associated male connector. Preferably, the elongated handle, end plates and male connectors are formed together as an integral unit from, for example, a plastic or metallic material. If the material used is porous or is not particularly smooth, then the engagement faces on the male connectors can be coated with a layer of a non-porous material.

The invention can further include a plurality of weights to be mounted to the handle and to each other. At least one of the weights further includes a male connector extending outwardly from an outer face thereon. In this manner, the female connector of each weight is complementary to and is adapted to be joined to the male connectors on either the end plates or on another weight. Preferably, the end plates, weights, male connectors and female connectors each have a right cylindrical shape. The handle can be provided either as a short dumbell handle or as a longer barbell handle.

DESCRIPTION OF THE PREFERRED EMBODIMENTS

Figure 1:
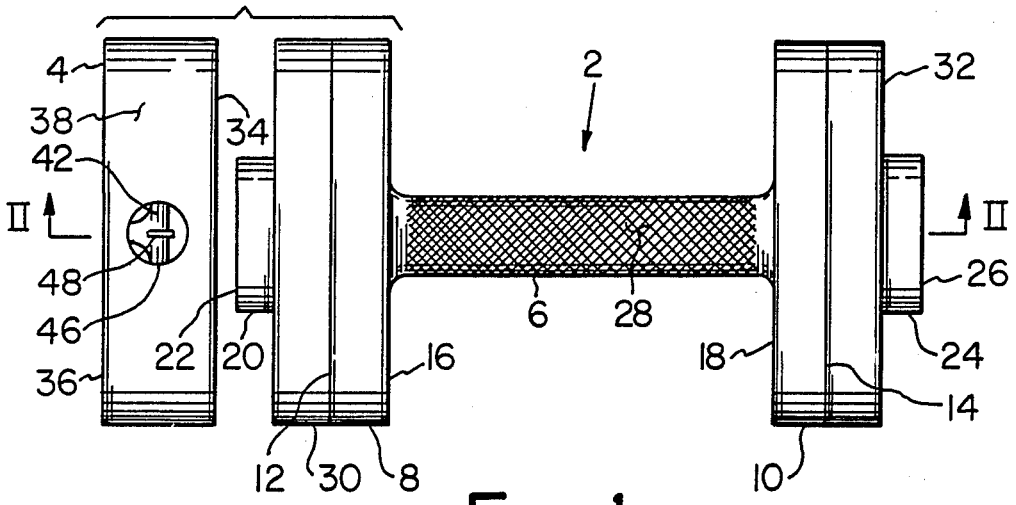
FIG. 1 is a side elevational view of one embodiment of a dumbell in accordance with the present invention.
Figure 2:
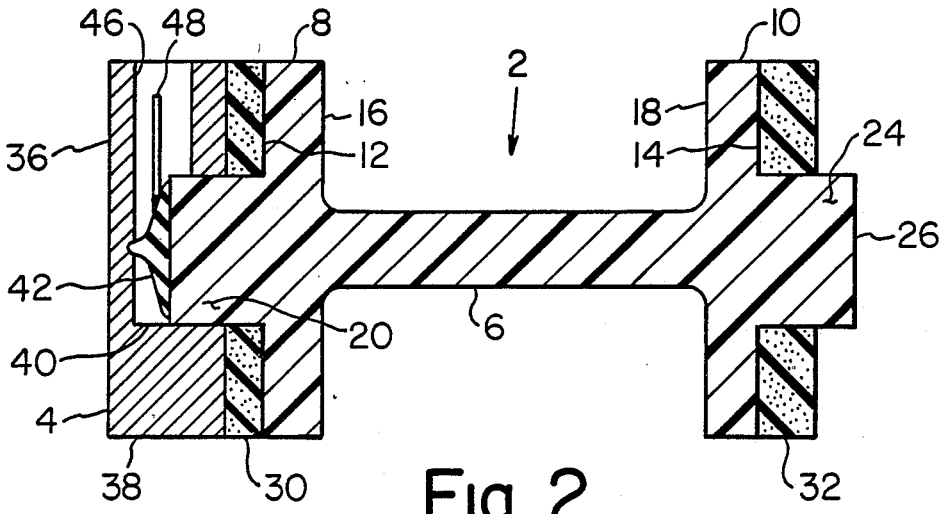
FIG. 2 is a section taken along lines II—II in FIG. 1.

Referring now to FIGS. 1 and 2, there is shown one embodiment of a dumbell in accordance with the present invention. The dumbell includes a central elongated dumbell handle 2 with one or more weights attached to each side of the handle 2. For illustrative purposes, a single weight 4 is shown attached to one side of the dumbell handle 2 in FIGS. 1 and 2. It is to be understood that additional weights can be attached to weight 4 as described hereinafter in more detail and that one or more weights would be attached to the other side of the dumbell handle 2. In addition, it is preferred to attach weights in an equal number and equal size to each side of the dumbell handle 2 in order to provide an evenly balanced dumbell.

Figure 3:
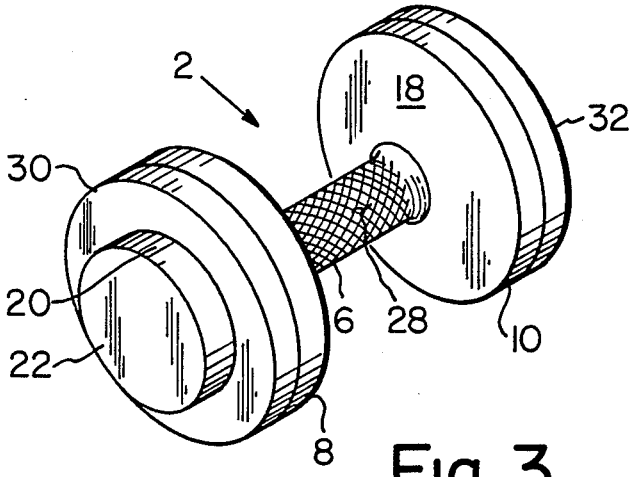
FIG. 3 is a perspective view of the handle of the dumbell shown in FIG. 1.
Figure 4:
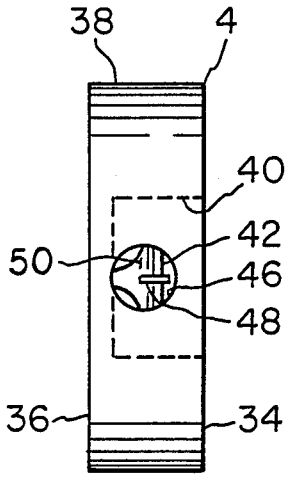
FIG. 4 is a side view of the weight of the dumbell shown in FIG. 1.
Figure 5:
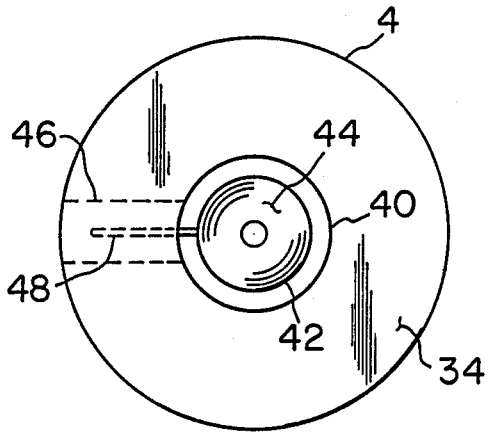
FIG. 5 is a front view of the weight shown in FIG. 4.

The dumbell handle 2, which is also shown in FIG. 3, includes a cylindrically-shaped dumbell bar 6 having end plates 8, 10 mounted on each end of the bar 6 and extending generally perpendicular thereto. The end plates 8, 10 are essentially shaped as a flat, right cylindrical member and each has an outer face 12, 14 opposite an inner face 16, 18 to which the bar 6 is attached. Male connector 20 is attached to end plate 8, extends outwardly therefrom, generally perpendicular to outer face 12, and ends in engagement face 22 spaced from and generally parallel to outer face 12. Likewise, male connector 24 is attached to end plate 10, extends outwardly therefrom, generally perpendicular to outer face 14, and ends in engagement face 26 spaced from and generally parallel to outer face 14. The dumbell bar 6 may include an outer knurled surface 28, as shown in FIGS. 1 and 3, to aid in effectively gripping the dumbell.

A flat ring of foam 30 can be mounted on the outer face 12 of end plate 8, surrounding male connector 20 attached thereto. Foam ring 30 is essentially an annular cylinder having a thickness less than the length of male connector 20. A similar foam ring 32 can be mounted on the outer face 14 of end plate 10, surrounding male connector 24. The dumbell bar 6, end plate 8, end plate 10, male connector 20 and male connector 24, which form the dumbell handle 2 of the present invention, are preferably formed together as an integral structure from metal, high strength plastic, or the like. The use of chrome plated metal results in a very attractive product. If the dumbell handle 2 is formed of a material which is porous or does not have a relatively smooth outer surface, then the engagement faces 22, 26 on the male connectors 20, 24 should be coated with a layer of a polyurethane varnish or other non-porous material.

The weight 4 shown in FIGS. 1, 2, 4 and 5 has a substantially right cylindrical body with an inner face 34, outer face 36 parallel thereto and side 38 extending therebetween. A female connector 40 is recessed into the inner face 34 of the weight 4 and has a configuration complementary to each male connector 20, 24 on the dumbell handle 2. A suction cup 42 or other suction means is mounted to the weight 4 at the bottom of the female connector 40 and is arranged with its engagement surface 44 oriented toward and substantially parallel to the inner face 34 and outer face 36 of the weight 4. An access hole 46 is provided in the weight 4 and extends from the side 38 to the female connector 40 therein. A release mechanism, such as an elongated release wire 48 as shown, is attached to a rear surface 50 of the suction cup 42 and extends at least partially into the access hole 46 and toward the side 38 of the weight 4.

The dumbell shown in FIGS. 1 and 2 may be easily assembled by positioning the weight 4 with the female connector 40 surrounding and in engagement with the male connector 20 on end plate 8 and with the inner face 34 of the weight 4 contacting foam ring 30 or contacting the outer face 12 of end plate 8 if no foam ring is provided. The weight 4 is moved along male connector 20, thereby compressing foam ring 30, until the engagement surface 44 of the suction cup 42 contacts and is securely connected to the engagement face 22 on male connector 20. At that point, the weight 4 is securely attached to the dumbell handle 2. A similar weight would be positioned on the male connector 24 on end plate 10 at the other end of the dumbell handle 2. The combination of the interaction between the male and female connectors, which keeps the weight from moving laterally, and the interaction between the suction cup and the engagement face on the male connector, which keeps the weight from moving axially, makes for a secure attachment of the weight on the dumbell handle. The foam rings 30, 32 cushion the contact area between the weight 4 and the end plates 8, 10 and provide a secure fit which is free from rattle or other free play.

The weight 4 will stay attached to the dumbell handle 2 until the connection of the suction cup 42 to male connector 20 is broken. By placing a finger in the access hole 46 and moving the release wire 48 toward the outer face 36 of the weight 4, the engagement surface 44 of the suction cup 42 is moved away from the engagement face 22 on male connector 20, and the connection therebetween is broken. The weight 4 can then be easily removed from the dumbell handle 2 and another weight can be easily attached by following the steps described above.

By merely positioning a weight 4 on the dumbell handle 2 and pressing the weight 4 in place, the weight 4 is quickly and easily attached. Likewise, by merely depressing the release wire 48, a weight 4 is quickly and easily removed. By using one dumbell handle and a number of weights in various sizes, the weights can be easily and quickly interchanged to form dumbells of any desired weight.

Figure 6:
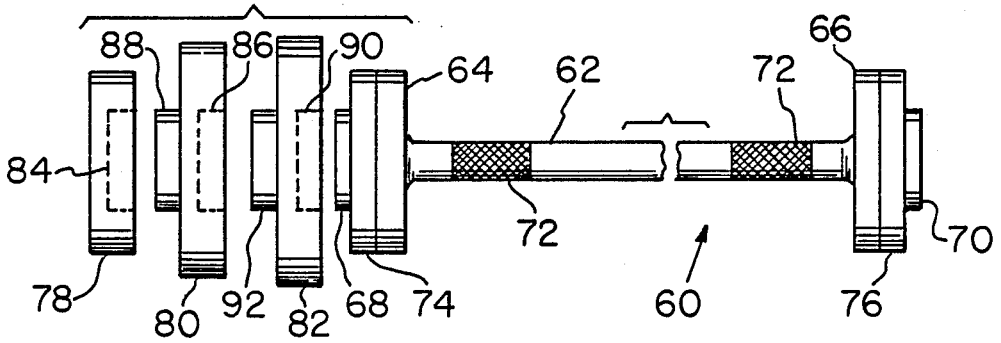
FIG. 6 is a side elevational view of one embodiment of a barbell in accordance with the present invention.

The dumbell handle 2 discussed above can be made sufficiently long enough so that the present invention can be used as a barbell. This is shown in FIG. 6 where a barbell handle 60 is formed of an elongated, cylindrical bar 62, end plates 64 and 66, and associated male connectors 68 and 70. The bar 62 may be provided with a pair of spaced knurled areas 72 to aid a user in gripping the bar 62. Foam rings 74, 76 may be mounted on the end plates 64, 66 surrounding the associated male connectors 68, 70.

FIG. 6 shows three weights 78, 80 and 82 being mounted onto end plate 64. Weight 78 is similar to weight 4 discussed above and includes female connector 84 therein. Weight 80 is similar to weight 78 and includes female connector 86 therein. However, weight 80 also includes a male connector 88 attached thereto and extending outwardly therefrom and perpendicular to an outer face thereof. Weight 82 is similar to weight 80 and includes both a female connector 90 therein and a male connector 92 extending outwardly therefrom. The female connectors 84, 86 and 90 on weights 78, 80 and 82 will include the suction cup therein. A release wire, extending through an access hole, will be attached to each suction cup. These features are not shown in FIG. 6 but are discussed in detail above in connection with FIGS. 4 and 5.

In the arrangement shown in FIG. 6, weight 82 is attached to the end plate 64 in the same manner discussed above in connection with FIGS. 1–5 through the interconnection of male connector 687 and female connector 90. Weight 80 is attached to weight 82 through the interconnection of male connector 92 and female connector 86. Likewise, weight 78 is attached to weight 80 through the interconnection of male connector 88 and female connector 84. In this manner, weights may be stacked together to form a larger weight attached at each end of the barbell handle 60. It is preferred that the weights be connected together first, then the entire weight assemblage attached to the barbell handle 60. A similar arrangement of stacked weights can be utilized with the dumbell handle 2 discussed above in connection with FIGS. 1–3.

Having described above the presently preferred embodiments of this invention, it is to be understood that the invention may be otherwise embodied within the scope of the appended claims.

I claim:

1. Weight training apparatus comprising:

(a) an elongated handle having an end plate on each end thereof;

(b) a male connector extending outwardly from an outer face of each of said end plates and having an engagement face thereon;

(c) at least one weight adapted to be mounted to each of said end plates on said handle, each of said weights including a weight body having an inner face thereon, a female connector recessed into said inner face of said weight and having a configuration complementary to said male connectors on said end plates, and a suction means attached to said weight within said female connector, wherein said female connector is adapted to engage said male connectors on said handle and said suction means is adapted to engage said engagement faces on said male connectors and thereby join a weight to said handle; and (d) release means for selectively releasing said suction means form engagement with the engagement faces of said male connectors.

2. The weight training apparatus of claim 1 wherein said suction means is a suction cup.

3. The weight training apparatus of claim 2 wherein said release means includes an access hole extending through said weight body to said female connector and a release wire connected to said suction cup and extending into said access hole.

4. The weight training apparatus of claim 1 further including a foam ring attached to the outer face of each of said end plates and surrounding said associated male connector.

5. The weight training apparatus of claim 1 wherein said elongated handle, said end plates and said male connectors are formed together as an integral unit.

6. The weight training apparatus of claim 1 wherein said elongated handle, said end plates and said male connectors are formed together as an integral unit of a plastic material.

7. The weight training apparatus of claim 6 wherein said engagement faces of said male connectors are coated with a layer of a non-porous material.

8. The weight training apparatus of claim 1 wherein said elongated handle, said end plates and said male connectors are formed together as an integral unit of metal.

9. The weight training apparatus of claim 1 further including a plurality of weights to be mounted to said handle and to each other, with at least one of said plurality of weights further including a male connector extending outwardly from an outer face thereon, wherein the female connector of each weight is complementary to and adapted to be joined to the male connectors on said end plates and to a male connector on a weight.

10. The weight training apparatus of claim 1 wherein said end plates, said weights, said male connectors and said female connectors each have a right cylindrical shape.

11. The weight training apparatus of claim 1 wherein said handle is a dumbell handle.

12. The weight training apparatus of claim 1 wherein said handle is a barbell handle.

13. Weight training apparatus comprising:

(a) an elongated handle having a cylindrical end plate on each end thereof;

(b) a cylindrical male connector extending outwardly from an outer face of each of said end plates and having an engagement face thereon;

(c) at least one cylindrical weight adapted to be mounted to each of said end plates on said handle, each of said weights including a weight body having an inner face thereon, a cylindrical female connector recessed into said inner face of said weight and having a configuration complementary to said male connectors on said end plates, and a suction means attached to said weight within said female connector, wherein said female connector is adapted to engage said male connectors on said handle and said suction means is adapted to engage said engagement faces on said male connectors and thereby join a weight to said handle; and (d) release means for selectively releasing said suction means form engagement with the engagement faces of said male connectors.

14. The weight training apparatus of claim 13 wherein said suction means is a suction cup.

15. The weight training apparatus of claim 14 wherein said release means includes an access hole extending through said weight body to said female connector and a release wire connected to said suction cup and extending into said access hole.

16. The weight training apparatus of claim 13 further including a foam ring attached to the outer face of each of said end plates and surrounding said associated male connector.

17. The weight training apparatus of claim 13 wherein said elongated handle, said end plates and said male connectors are formed together as an integral unit.

18. The weight raining apparatus of claim 13 further including a plurality of weights to be mounted to said handle and to each other, with at least one of said plurality of weights further including a cylindrical male connector extending outwardly from an outer face thereon, wherein the female connector of each weight is complementary to and adapted to be joined to the male connectors on said end plates and to a male connector on a weight.

19. The weight training apparatus of claim 13 wherein said handle is a dumbell handle.

20. The weight training apparatus of claim 13 wherein said handle is a barbell handle.

* * * * *

UNITED STATES PATENT AND TRADEMARK OFFICE

CERTIFICATE OF CORRECTION

PATENT NO. : 4,948,123

DATED : August 14, 1990

INVENTOR(S) : Michael N. Schook

It is certified that error appears in the above-identified patent and that said Letters Patent is hereby corrected as shown below:

Column 4 Line 56 "687" should read --68--.

Claim 1 (d) Line 26 Column 5 "form" should read --from--.

Claim 13 (d) Line 31 Column 6 "form" should read --from--.

Claim 18 Line 47 Column 6 "raining" should read --training--.

Signed and Sealed this

Tenth Day of December, 1991

*Attest:*

HARRY F. MANBECK, JR.

*Attesting Officer*

*Commissioner of Patents and Trademarks*